US007738812B2

(12) United States Patent
Kim et al.

(10) Patent No.: US 7,738,812 B2
(45) Date of Patent: Jun. 15, 2010

(54) IMAGE FORMING APPARATUS

(75) Inventors: Soo Yong Kim, Seoul (KR); Mun Bo Shim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 276 days.

(21) Appl. No.: 12/046,625

(22) Filed: Mar. 12, 2008

(65) Prior Publication Data

US 2009/0028589 A1 Jan. 29, 2009

(30) Foreign Application Priority Data

Mar. 23, 2007 (KR) ..... 10-2007-0028896
Jan. 18, 2008 (KR) ..... 10-2008-0005765

(51) Int. Cl.
*G03G 15/00* (2006.01)

(52) U.S. Cl. ..... 399/167; 399/301

(58) Field of Classification Search ..... 399/38, 399/39, 66, 130, 159, 167, 297–301; 74/412 R
See application file for complete search history.

(56) References Cited

U.S. PATENT DOCUMENTS

| | | | | |
|---|---|---|---|---|
| 6,453,139 | B2 * | 9/2002 | Sasame et al. | 399/167 |
| 7,206,537 | B2 * | 4/2007 | Funamoto et al. | 399/167 |
| 7,373,097 | B2 * | 5/2008 | Ehara | 399/167 |
| 2008/0271556 | A1 * | 11/2008 | Imamura et al. | 74/412 R |

FOREIGN PATENT DOCUMENTS

JP 11-052651 2/1999

OTHER PUBLICATIONS

English language abstract of JP 11-052651, published Feb. 26, 1999.

* cited by examiner

*Primary Examiner*—Hoan Tran
(74) *Attorney, Agent, or Firm*—DLA Piper LLP US

(57) ABSTRACT

An image forming apparatus capable of minimizing color mis-registration due to runout of gears is disclosed. The image forming apparatus includes a plurality of photosensitive bodies having transfer points to transfer images onto a transfer object, a driving source to drive at least two photosensitive bodies of the plurality of photosensitive bodies, and a driving gear train to transmit driving power from the driving source to the at least two photosensitive bodies. The driving gear train includes photosensitive body shaft gears respectively connected to the photosensitive bodies driven by the driving source, and connecting gears to transmit the driving power to the photosensitive body shaft gears. When any one of the photosensitive body shaft gears is set to a reference photosensitive body shaft gear, the number of teeth of the connecting gear, which is disposed at a $j^{th}$ position from the reference photosensitive body shaft gear, is determined so that a value calculated from the following equation is substantially an integer.

$$\frac{L}{\pi D} \cdot \frac{1}{R_j}$$

Here, D refers to a diameter of each of the photosensitive bodies, L refers to a distance between the transfer points of two adjacent photosensitive bodies, and $R_j$ refers to a speed reduction ratio from the $j^{th}$ connecting gear to the reference photosensitive body shaft gear.

22 Claims, 9 Drawing Sheets

IMAGE FORMING APPARATUS

CROSS-REFERENCE TO RELATED APPLICATION

This application claims the benefit of Korean Patent Application No. 2007-0028896, filed on Mar. 23, 2007 and No. 2008-5765, filed on Jan. 18, 2008 in the Korean Intellectual Property Office, the disclosure of which is incorporated herein by reference.

BACKGROUND OF THE INVENTION

1. Field of the Invention

The present invention relates to an image forming apparatus, and more particularly, to an image forming apparatus which performs color printing by use of a plurality of photosensitive bodies.

2. Description of the Related Art

An image forming apparatus refers to an apparatus that prints an image on a printing medium, e.g., paper, according to an inputted image signal. An image forming apparatus is classified as a printer, a copying machine, a fax machine, a multi-function printer which has multiple functions of printing, scanning, copying and faxing, and the like.

An electrophotographic image forming apparatus is configured such that light is scanned to a photosensitive body charged to a predetermined electric potential to form an electrostatic latent image on a surface of the photosensitive body, the electrostatic latent image is developed into a visible image by supplying a developer to the electrostatic latent image, and the visible image is transferred onto and fused on paper. Through the above processes, the image is printed.

Of the electrophotographic color image forming apparatus, there is a so-called tandem type image forming apparatus, which includes photosensitive bodies and developing devices as many as the number of colors used in printing.

Typically, since a color image forming apparatus uses toners of four colors of yellow, magenta, cyan and black, a tandem type image forming apparatus includes four photosensitive bodies and four developing devices, corresponding to the respective colors.

In a tandem type image forming apparatus, electrostatic latent images are formed on the respective photosensitive bodies, corresponding to image information of the respective colors. Toners of respective colors are supplied to the electrostatic latent images formed on the respective photosensitive bodies from the corresponding developing devices. Accordingly, visible images are formed on the surfaces of the respective photosensitive bodies by colors. The visible images formed on the photosensitive bodies are sequentially and overlappingly transferred onto an intermediate transfer body (e.g., an intermediate transfer belt or an intermediate transfer drum), and then are finally transferred onto paper. Alternatively, the visible images formed on the photosensitive bodies are directly transferred onto paper and overlapped.

The tandem type image forming apparatus has an advantage of achieving the high-speed printing. However, because the tandem type image forming apparatus performs the color printing by overlapping the images formed on the respective photosensitive bodies by colors, image deterioration due to color mis-registration frequently occurs.

The color mis-registration occurs by composite action of various factors. Of them, a major cause of the color mis-registration is a change of a linear velocity of the photosensitive body due to runout of gears that transmit driving power between a driving source and the photosensitive body.

This kind of problem may be solved by using high precision gears. However, this solution is not preferable because there is a limitation in a process of manufacturing gears highly precisely and a great increase in costs is caused.

Alternatively, if installing driving sources on the photosensitive bodies with one-to-one correspondence, the color mis-registration due to runout of gears may be easily prevented by independently controlling the respective driving sources through a simple program. However, this solution also is not preferable because of a failure in reduction of costs.

SUMMARY OF THE INVENTION

Therefore, it is an aspect of the invention to provide an image forming apparatus that is capable of minimizing color mis-registration due to runout of gears when it is constituted such that a single driving source drives at least two photosensitive bodies.

In accordance with an aspect of the invention, there is provided an image forming apparatus comprising: a plurality of photosensitive bodies having transfer points to transfer images onto a transfer object; a driving source to drive at least two photosensitive bodies of the plurality of photosensitive bodies; and a driving gear train to transmit driving power from the driving source to the at least two photosensitive bodies, the driving gear train including photosensitive body shaft gears respectively connected to the photosensitive bodies driven by the driving source, and connecting gears to transmit the driving power to the photosensitive body shaft gears. When one of the photosensitive body shaft gears is set to a reference photosensitive body shaft gear, the number of teeth of the connecting gear, which is disposed at a $j^{th}$ position from the reference photosensitive body shaft gear, is determined so that a value calculated from the following equation is substantially an integer:

$$\frac{L}{\pi D} \cdot \frac{1}{R_j}$$

here, D refers to a diameter of each of the photosensitive bodies, L refers to a distance between the transfer points of two adjacent photosensitive bodies, and $R_j$ refers to a speed reduction ratio from the $j^{th}$ connecting gear to the reference photosensitive body shaft gear.

The value may have an integer value within an error range of plus or minus 0.1.

At least a part of the gears arranged in the driving gear train may be adjusted in an initial installation position according to a runout profile of each of the gears.

At least a part of the gears arranged in the driving gear train may include a datum mark which serves as a reference in determining the runout profile.

The connecting gears may include a division gear to divide the driving power transmitted from the driving source, and the gears arranged between the division gear and the photosensitive bodies may be adjusted in the initial installation positions according to the runout profiles of the respective gears.

The plurality of photosensitive bodies may include a first photosensitive body, a second photosensitive body, a third photosensitive body and a fourth photosensitive body.

The driving source may drive the first photosensitive body, the second photosensitive body, the third photosensitive body and the fourth photosensitive body.

The driving source may drive the first photosensitive body and the second photosensitive body.

The driving source may drive the first photosensitive body, the second photosensitive body and the third photosensitive body.

In accordance with another aspect of the invention, there is provided an image forming apparatus comprising: a plurality of photosensitive bodies having transfer points to transfer images onto a transfer object; at least one driving source provided fewer than the photosensitive bodies, to drive the plurality of photosensitive bodies; and at least one driving gear train to transmit driving power from the driving source to the plurality of photosensitive bodies, the at least one driving gear train including a first gear, and a second gear disposed at a $j^{th}$ position from the first gear. The second gear is provided so as to satisfy the following equation:

$$\frac{L}{\pi D} \cdot \frac{1}{R_j} = k + \alpha$$

here, D refers to a diameter of each of the photosensitive bodies, L refers to a distance between the transfer points of two adjacent photosensitive bodies, $R_j$ refers to a speed reduction ratio from the second gear to the first gear serving as a reference gear, k refers to an integer value, and a refers to a value satisfying a condition of $-0.1 \leqq \alpha \leqq 0.1$.

The at least one driving gear train may include photosensitive body shaft gears respectively connected to the photosensitive bodies, and the first gear may be configured as one of the photosensitive body shaft gears.

At least a part of the gears arranged in the driving gear train may be adjusted in an initial installation position according to a runout profile of each of the gears.

Each of the gears arranged in the driving gear train may include a datum mark which serves as a reference in determining the runout profile.

The at least one driving source may include a first driving source and a second driving source. The first driving source may drive one pair of photosensitive bodies of the plurality of photosensitive bodies, and the second driving source may drive another pair of photosensitive bodies of the plurality of photosensitive bodies.

The at least one driving source may include a first driving source and a second driving source. The first driving source may drive three photosensitive bodies of the plurality of photosensitive bodies, and the second driving source may drive the remaining photosensitive bodies.

The at least one driving source may drive at least four photosensitive bodies of the plurality of photosensitive bodies.

According to another aspect, a method of providing rotational force from at least one driving source to a plurality of photosensitive bodies in an image forming apparatus, the at least one driving source being less in number than the plurality of photosensitive bodies, the method comprising providing a driving gear train including a plurality of gears, the driving gear train being configured to reduces rotational velocity of the rotational force provided by the at least one driving source, and to deliver the rotational force at the reduced rotational velocity to the plurality of photosensitive bodies, wherein, for at least a first subset of the plurality of gears that delivers the rotational force at the reduced rotational velocity to a first one of the plurality of photosensitive bodies, the plurality of gears of the first subset is arranged to satisfy a relationship defined by:

$$\frac{L}{\pi D} \cdot N = k,$$

wherein L is a distance between rotational axial centers of adjacent ones of the plurality of photosensitive bodies, D is a diameter of the first one of the plurality of photosensitive bodies, N is a first value obtained from multiplying one or more gear ratios between each engaged pair of gears of the first subset, and k is substantially an integer value.

According to yet another aspect, k is within ±0.1 of an integer value.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF SEVERAL EMBODIMENTS

Figure 1:
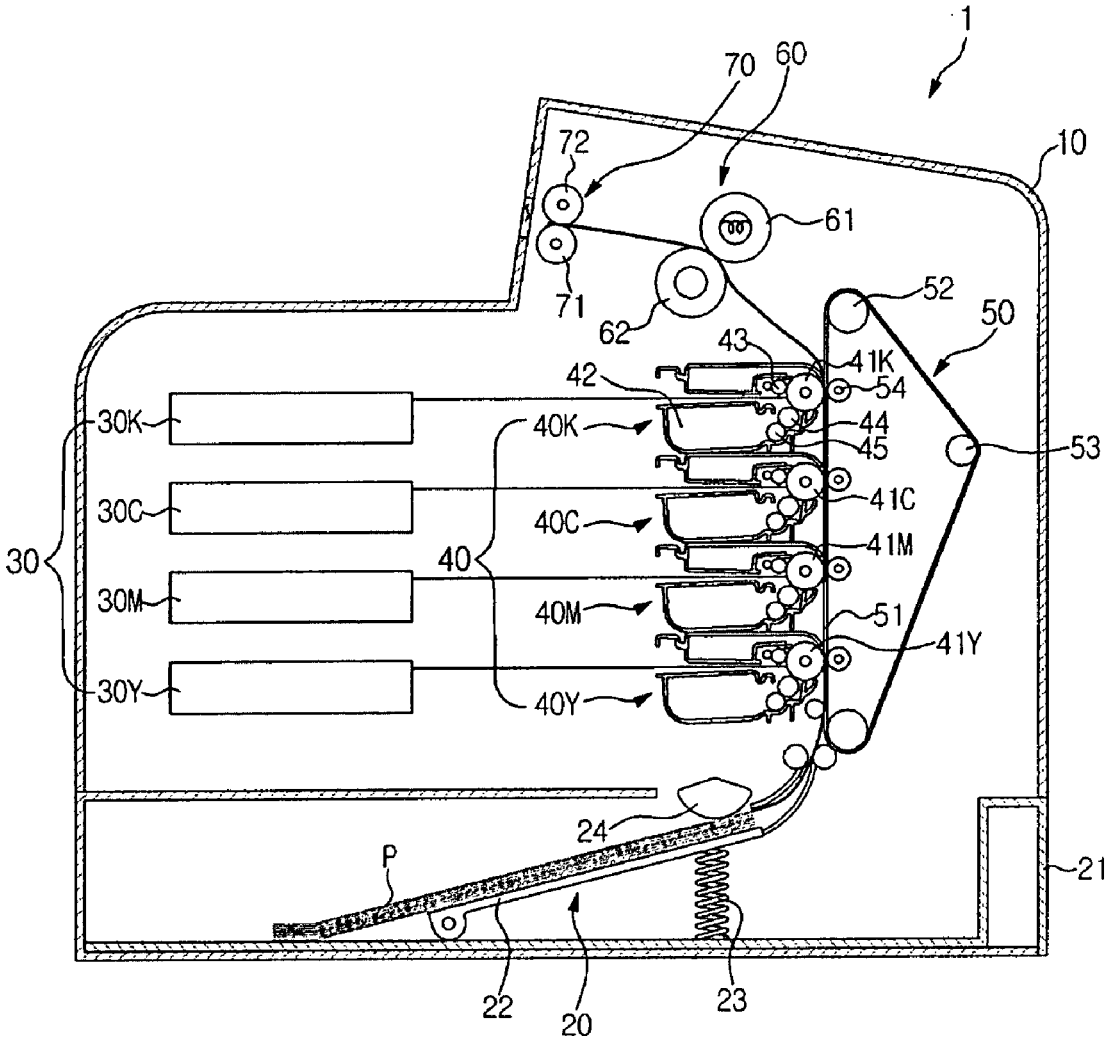
FIG. 1 is a view illustrating a constitution of an image forming apparatus according to an exemplary embodiment of the present invention.

Reference will now be made in detail to various embodiments of the present invention, examples of which are illustrated in the accompanying drawings, wherein like reference numerals refer to like elements throughout. FIG. 1 is a view illustrating a constitution of an image forming apparatus according to an exemplary embodiment of the present invention.

As shown in FIG. 1, an image forming apparatus 1 according to the present invention includes a main body 10 which forms an exterior appearance. The image forming apparatus 1 further includes a paper feeding unit 20, a laser scanning unit 30, a developing unit 40, a transfer unit 50, a fusing unit 60 and a paper discharge unit 70, which are accommodated in the main body 10.

The paper feeding unit 20 includes a paper cassette 21 which is removably mounted in a lower portion of the main body 10, a paper supporting plate 22 which is up/down pivotably coupled in the paper cassette 21 and on which paper P is loaded, an elastic member 23 which is provided under the paper supporting plate 22 and elastically supports the paper supporting plate 22, and a pickup roller 24 which is provided at a position corresponding to a front end portion of the paper loaded on the paper supporting plate 22 and picks up the paper.

The developing unit 40 includes four developing devices 40Y, 40M, 40C and 40K, in which toners of different colors, e.g., yellow (Y), magenta (M), cyan (C) and black (K) toners are respectively stored. The developing devices 40Y, 40M, 40C and 40K are respectively provided with photosensitive bodies 41Y, 41M, 41C and 41K, on surfaces of which electrostatic latent images are formed by the laser scanning unit 30. Although it is illustrated in FIG. 1 that the photosensitive bodies 41Y, 41M, 41C and 41K are mounted in the respective developing devices 40Y, 40M, 40C and 40K, the photosensitive bodies 41Y, 41M, 41C and 41K may be mounted in the main body 10, separately from the developing devices 40Y, 40M, 40C and 40K.

Respective laser scanning units 30Y, 30 M, 30C and 30K irradiate light, corresponding to image information of yellow, magenta, cyan and black, to the respective photosensitive bodies 41Y, 41M, 41C and 41K according to a printing signal.

Each of the developing devices 40Y, 40M, 40C and 40K includes a toner storage part 42 to store the toner, a charge roller 43 to charge each of the photosensitive bodies 41Y, 41M, 41C and 41K, a developing roller 44 to develop the electrostatic latent image formed on each of the photosensitive bodies 41Y, 41M, 41C and 41K into a toner image, and a supply roller 45 to supply the toner to the developing roller 44.

The transfer unit 50 serves to transfer the toner images developed on the photosensitive bodies onto the paper. The transfer unit 50 includes a transfer belt 51 which circulates in contact with the photosensitive bodies 41Y, 41M, 41C and 41K, a driving roller 52 which drives the transfer belt 51, a tension roller 53 which keeps tension of the transfer belt 51 constant, and four transfer rollers 54 which transfer the toner images formed on the photosensitive bodies 41Y, 41M, 41C and 41K onto the paper.

The fusing unit 60 serves to fuse the toner images to the paper by applying heat and pressure to the paper. The fusing unit 60 includes a heating roller 61 which has a heat source to heat the toner-transferred paper, and a press roller 62 which is mounted while opposing the heating roller 61 and maintains the constant fusing pressure with the heating roller 61.

The paper discharge unit 70 serves to discharge the printed paper outside the main body 10. The paper discharge unit 70 includes a discharge roller 71, and a discharge backup roller 72 which rotates together with the discharge roller 71.

The image forming apparatus 1 further includes a driving unit to drive the respective photosensitive bodies 41Y, 41M, 41C and 41K. The driving unit includes at least one driving source, and at least one driving gear train which is arranged between the driving source and the photosensitive bodies to transmit driving power from the driving source to the photosensitive bodies.

Figure 2:
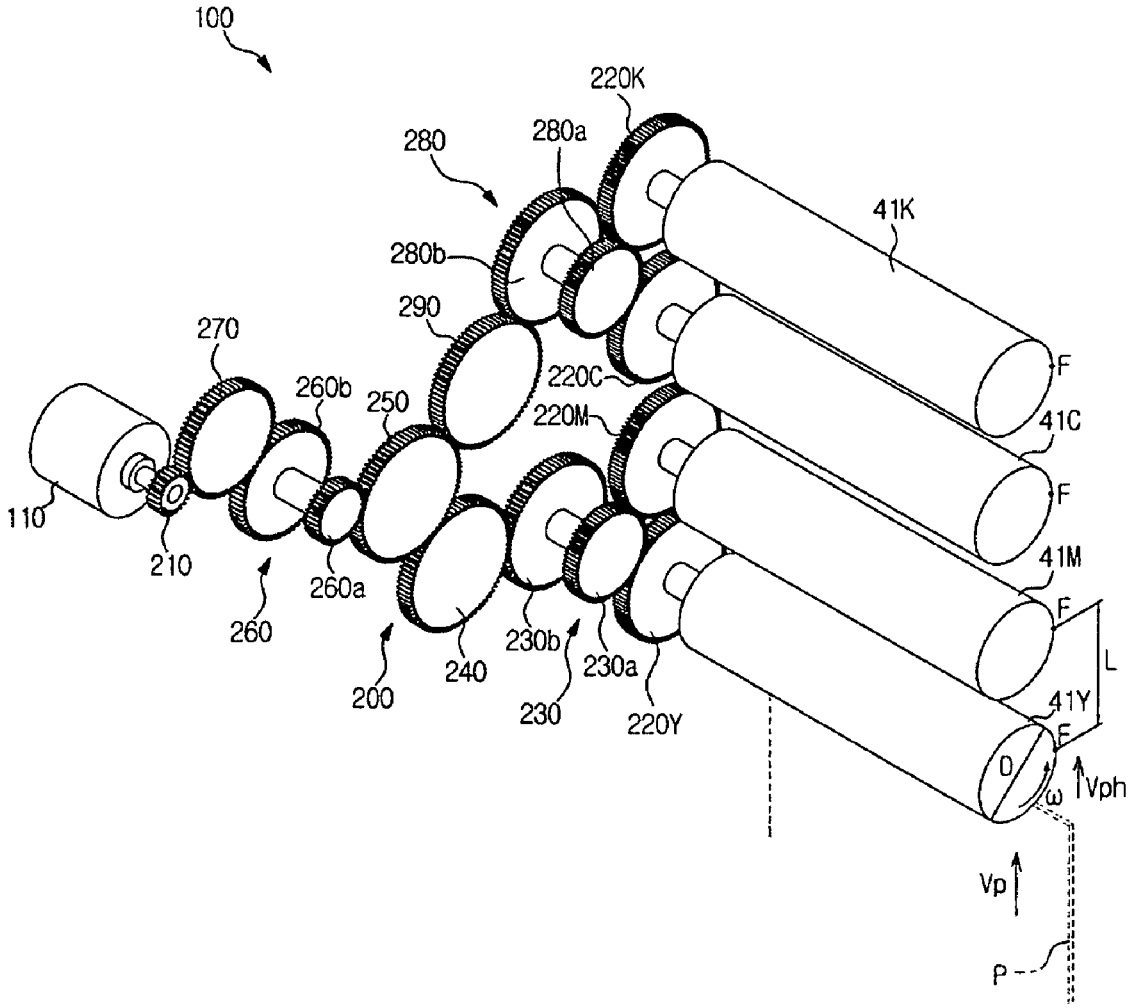
FIG. 2 is a perspective view illustrating photosensitive bodies and a driving unit according to a first embodiment of the present invention.
Figure 3:
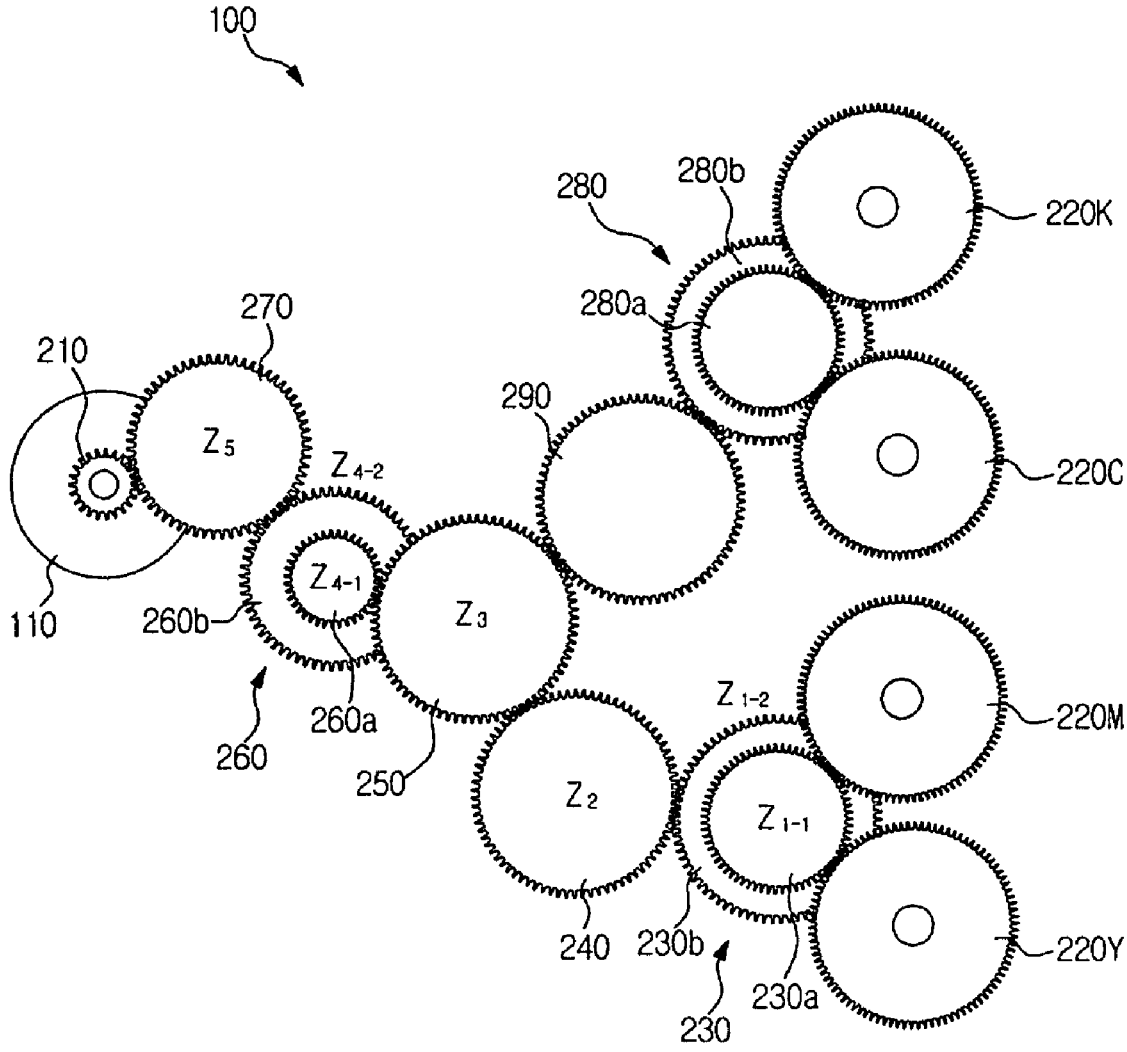
FIG. 3 is a side view illustrating the driving unit depicted in FIG. 2.

FIG. 2 is a perspective view illustrating the photosensitive bodies and a driving unit according to a first embodiment of the present invention, and FIG. 3 is a side view illustrating the driving unit depicted in FIG. 2.

As shown in FIGS. 2 and 3, a driving unit 100 includes a driving source 110, and a driving gear train 200 which transmits driving power from the driving source 110 to the respective photosensitive bodies 41Y, 41M, 41C and 41K.

The driving gear train 200 includes a driving shaft gear 210 connected to the driving source 110, photosensitive body shaft gears 220Y, 220M, 220C and 220K connected to the respective photosensitive bodies 41Y, 41M, 41C and 41K, and a series of connecting gears to transmit the driving power from the driving source 110 to the respective photosensitive body shaft gears 220Y, 220M, 220C and 220K at a reduced speed by a predetermined speed reduction ratio.

The connecting gears include a first connecting gear 230 to transmit the driving power to the two photosensitive bodies 41Y and 41M, second to fifth connecting gears 240, 250, 260 and 270 which are sequentially connected from the first connecting gear 230 to the driving shaft gear 210, a sixth connecting gear 280 to transmit the driving power to the two photosensitive bodies 41C and 41K, and a seventh connecting gear 290 which receives the driving power from the third connecting gear 250 and transmits the driving power to the sixth connecting gear 280.

The first connecting gear 230, the fourth connecting gear 260 and the sixth connecting gear 280 serve as a speed reduction gear, and respectively include first gear parts 230*a*, 260*a* and 280*a* and second gear parts 230*b*, 260*b* and 280*b*, which have different sizes from each other.

The driving power of the driving source 110 is transmitted to the third connecting gear 250 via the fifth connecting gear 270 and the fourth connecting gear 260, and is divided at the third connecting gear 250 in two directions, so as to be transmitted to the second connecting gear 240 and the seventh connecting gear 290. The driving power transmitted to the second connecting gear 240 rotates the two photosensitive bodies 41Y and 41M via the first connecting gear 230, and the driving power transmitted to the seventh connecting gear 290 rotates the two photosensitive bodies 41C and 41K via the sixth connecting gear 280.

The gears arranged in the driving gear train 200 have runout, i.e., eccentricity, due to various reasons in a manufacturing process (e.g., an injection molding condition or a gate position). The runout of the gears compositely influences the photosensitive body shaft gears 220Y, 220M, 220C and 220K during the power transmitting process, and accordingly color mis-registration may occur due to change of a linear velocity of each of the photosensitive bodies 41Y, 41M, 41C and 41K.

In this regard, the present invention determines the number of teeth of each gear so that the gears arranged in the driving gear train 200 are rotated synchronously with each other, and adjusts an initial installation phase of each gear in consideration of the runout profile of each gear, to thereby minimize the color mis-registration due to runout of the gears.

First, so as for the gears arranged in the driving gear train 200 to be rotated synchronously with each other, the gears of the driving gear train 200 are configured to satisfy the following equation 1.

$$\frac{\Delta t}{T_j} = k + \alpha \qquad \text{Equation 1}$$

Here, when any one of the photosensitive body shaft gears 220Y, 220M, 220C and 220K is set to a reference photosensitive body shaft gear, $T_j$ refers to a period of rotation of the gear which is disposed at the $j^{th}$ position from the reference photosensitive body shaft gear. $\Delta t$ refers to a time taken for the paper P to move a distance L from a transfer point F of one photosensitive body to a transfer point F of the next photosensitive body.

k refers to an arbitrary integer value, and $\alpha$ refers to a constant value representing an allowable error range. $\alpha$ can be suitably selected so that a value of dividing $\Delta t$ by $T_j$ becomes substantially an integer value, and preferably is determined to a value satisfying a condition of $-0.1 \leqq \alpha \leqq 0.1$.

If disregarding a slip of the paper P passing by the photosensitive body, since a conveying velocity Vp of the paper is equal to a linear velocity Vph of the photosensitive body, $\Delta t$ is expressed as follows. D refers to a diameter of the photosensitive body, and $\omega$ refers to an angular speed of the photosensitive body.

$$\Delta t = \frac{2L}{D\omega}$$

Also, when a speed reduction ratio from the $j^{th}$-positioned connecting gear to the reference photosensitive body shaft gear is referred to as $R_j$ and a period of rotation of the photosensitive body is referred to as T, since the period of rotation $T_j$ of the $j^{th}$-positioned connecting gear can be expressed by $R_j \times T$, the above equation 1 can be rearranged as the following equation 2.

$$\frac{\Delta t}{T_j} = \frac{\Delta t}{R_j T} = \frac{L}{\pi D} \cdot \frac{1}{R_j} = k + \alpha \qquad \text{Equation 2}$$

That is, in the state that the distance L, the diameter D of the photosensitive body and the number of teeth of the reference photosensitive body shaft gear are determined, the number of teeth of the $j^{th}$-positioned connecting gear from the reference photosensitive body shaft gear is determined so as to satisfy the above equation 2.

For example, the reference photosensitive body shaft gear may be set by 220Y, the number of teeth of the photosensitive body shaft gear 220Y may be set to 94, a distance L may be set to 54 mm, and the diameter D of the photosensitive body may be set to 24 mm.

In such a case, the number of teeth $Z_{1-1}$ of the first gear part 230*a* of the first connecting gear 230, which is disposed at the first position from the photosensitive body shaft gear 220Y, can be determined to about 67 from the following equation 3 of inputting the above values into the above equation 2.

$$\frac{\Delta t}{T_1} = \frac{\Delta t}{R_1 T} = \frac{L}{\pi D} \cdot \frac{1}{R_1} = \frac{54}{24\pi} \cdot \frac{94}{Z_{1-1}} = 1.01 \qquad \text{Equation 3}$$

The second gear part 230*b* of the first connecting gear 230 is mounted coaxially with the first gear part 230*a*, and can be suitably selected in consideration of an overall speed reduction ratio which is required in the driving gear train 200. In this embodiment, the number of teeth $Z_{1-2}$ of the second gear part 230*b* of the first connecting gear 230 is determined to 78.

The number of teeth $Z_2$ of the second connecting gear 240, which is disposed at the second position from the photosensitive body shaft gear 220Y, and the number of teeth $Z_3$ of the third connecting gear 250, which is disposed at the third position from the photosensitive body shaft gear 220Y, can be respectively determined to 78 from the following equations 4 and 5 of inputting the above values into the above equation 2.

$$\frac{\Delta t}{T_2} = \frac{\Delta t}{R_2 T} = \frac{L}{\pi D} \cdot \frac{1}{R_2} = \frac{54}{24\pi} \cdot \frac{94}{Z_{1-1}} \cdot \frac{Z_{1-2}}{Z_2} = 1.01 \qquad \text{Equation 4}$$

$$\frac{\Delta t}{T_3} = \frac{\Delta t}{R_3 T} = \frac{L}{\pi D} \cdot \frac{1}{R_3} = \frac{54}{24\pi} \cdot \frac{94}{Z_{1-1}} \cdot \frac{Z_{1-2}}{Z_2} \cdot \frac{Z_2}{Z_3} = 1.01 \qquad \text{Equation 5}$$

The number of teeth $Z_{4-1}$ of the first gear part 260*a* of the fourth connecting gear 260, which is disposed at the fourth position from the photosensitive body shaft gear 220Y, can be determined to about 39 from the following equation 6 of inputting the above values into the above equation 2.

$$\frac{\Delta t}{T_4} = \frac{\Delta t}{R_4 T} = \frac{L}{\pi D} \cdot \frac{1}{R_4} = \frac{54}{24\pi} \cdot \frac{94}{Z_{1-1}} \cdot \frac{Z_{1-2}}{Z_2} \cdot \frac{Z_2}{Z_3} \cdot \frac{Z_3}{Z_{4-1}} = 2.01 \qquad \text{Equation 6}$$

The second gear part 260*b* of the fourth connecting gear 260 is mounted coaxially with the first gear part 260*a*, and can be suitably selected in consideration of an overall speed reduction ratio which is required in the driving gear train 200. In this embodiment, the number of teeth $Z_{4-2}$ of the second gear part 260*b* of the fourth connecting gear 260 is determined to 63.

The number of teeth $Z_5$ of the fifth connecting gear 270, which is disposed at the fifth position from the photosensitive body shaft gear 220Y, can be determined to 63 from the following equation 7 of inputting the above values into the above equation 2.

$$\frac{\Delta t}{T_5} = \frac{\Delta t}{R_5 T} = \frac{L}{\pi D} \cdot \frac{1}{R_5} = \frac{54}{24\pi} \cdot \frac{94}{Z_{1-1}} \cdot \frac{Z_{1-2}}{Z_2} \cdot \frac{Z_2}{Z_3} \cdot \frac{Z_3}{Z_{4-1}} \cdot \frac{Z_{4-2}}{Z_5} = 2.01 \qquad \text{Equation 7}$$

In the above, the numbers of teeth of the respective gears were determined under the condition such that the values of k with respect to the first to fifth connecting gears 230, 240, 250, 260 and 270 are set to 1, 1, 1, 2 and 2, respectively, and the value of $\alpha$ is set to 0.01. However, the value of $k+\alpha$ should be suitably selected in consideration of an overall speed reduction ratio which is required in the driving gear train 200.

The sixth connecting gear 280 may use the same gear as the first connecting gear 230, and the seventh connecting gear 290 may use the same gear as the second connecting gear 240.

As such, after making the gears arranged in the driving gear train 200 rotate synchronously with each other, the installation phases of the gears are determined, so as to minimize color mis-registration, in consideration of the runout of each of the gears.

If using an instrument capable of measuring the runout of the gear (e.g., Double Flank Gear Rolling Test Instrument (DF-10/MT type, TechnoMax, Inc.)), data with respect to the runout profiles of all gears arranged in the driving gear train 200 can be derived.

If the runout profiles of the gears arranged in the driving gear train 200 are derived, the installation phases of the gears can be determined through a numerical analysis method using evolutionary algorithms or a trial-and-error method so as to minimize the color mis-registration.

At this time, the installation phases with respect to all gears arranged in the driving gear train 200 may be determined, or the installation phases may be determined in consideration of only some of the gears arranged in the driving gear train 200.

However, when considering only some gears, it is preferable to consider the installation phases with respect to the gears arranged between the gear dividing the driving power from the driving source 110 and the photosensitive bodies.

Figure 4:
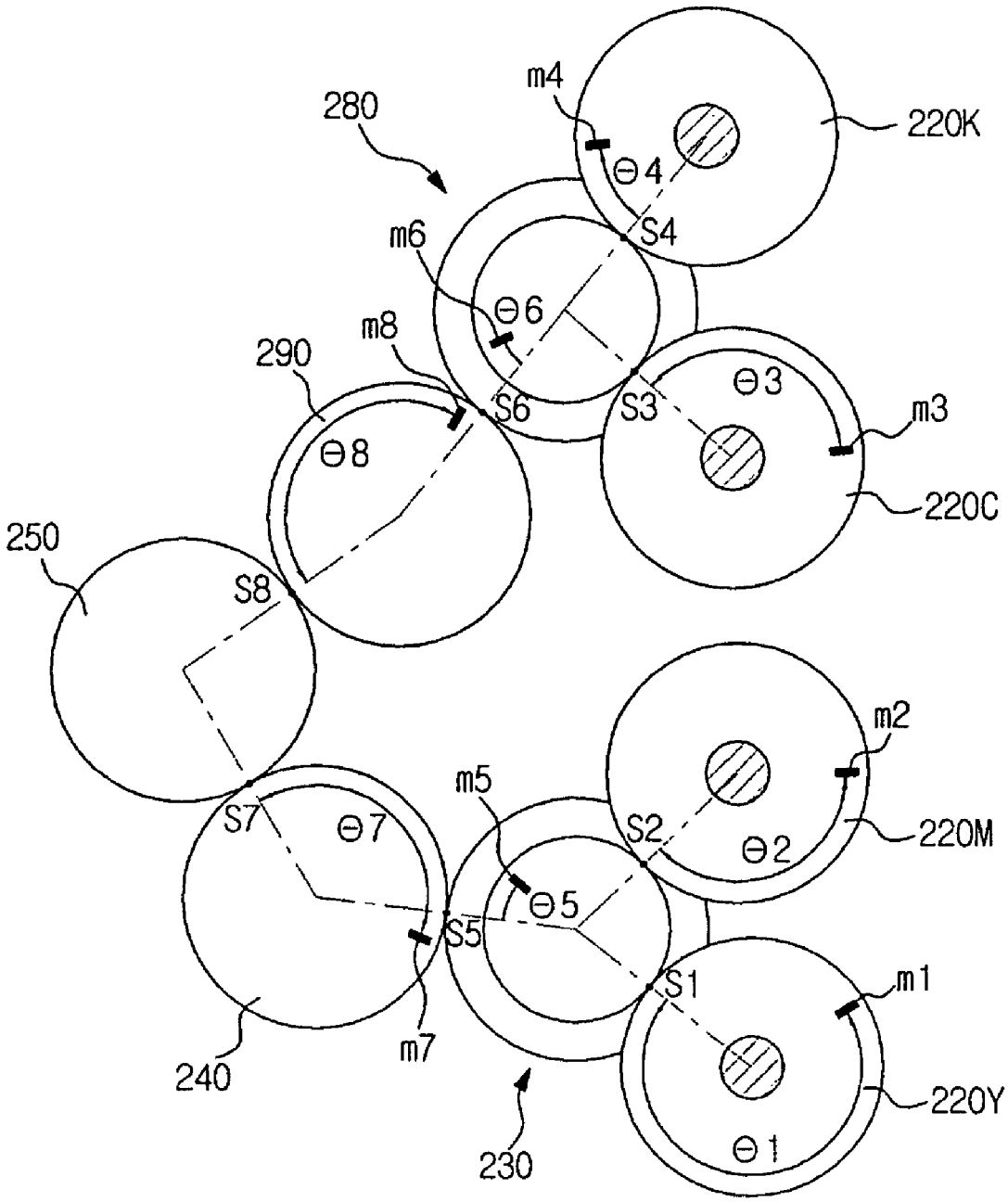
FIG. 4 is a view illustrating an example of determining installation phases of some gears arranged in driving gear train depicted in FIG. 3.

FIG. 4 illustrates an example of determining the installation phases of the gears arranged in the driving gear train depicted in FIG. 3. In FIG. 4, the installation phases with respect to the eight gears 220Y, 220M, 220C, 220K, 230, 280, 240 and 290, which are arranged between the third connecting gear 250 dividing the driving power from the driving source 110 and the photosensitive bodies, were considered.

The gears 220Y, 220M, 220C, 220K, 230, 280, 240 and 290, which are considered in determining the installation phases, as shown in FIG. 4, have datum marks m1, m2, m3, m4, m5, m6, m7 and m8 related to the runout. The runout profiles of the respective gears 220Y, 220M, 220C, 220K, 230, 280, 240 and 290 can be determined on the basis of the datum marks.

If the runout profiles of the respective gears 220Y, 220M, 220C, 220K, 230, 280, 240 and 290 are determined on the basis of the datum marks m1, m2, m3, m4, m5, m6, m7 and m8, the installation phases of the datum marks m1, m2, m3, m4, m5, m6, m7 and m8 can be determined through a numerical analysis method using evolutionary algorithms so as to minimize the color mis-registration.

That is, as shown in FIG. 4, the gears 220Y, 220M, 220C, 220K, 230, 280, 240 and 290 can be installed in such a manner that the datum marks m1, m2, m3, m4, m5, m6, m7 and m8 with respect to the gears 220Y, 220M, 220C, 220K, 230, 280, 240 and 290 are rotated from reference points S1, S2, S3, S4, S5, S6, S7 and S8 by angles of θ1, θ2, θ3, θ4, θ5, θ6, θ7 and θ8, respectively.

Figure 5:
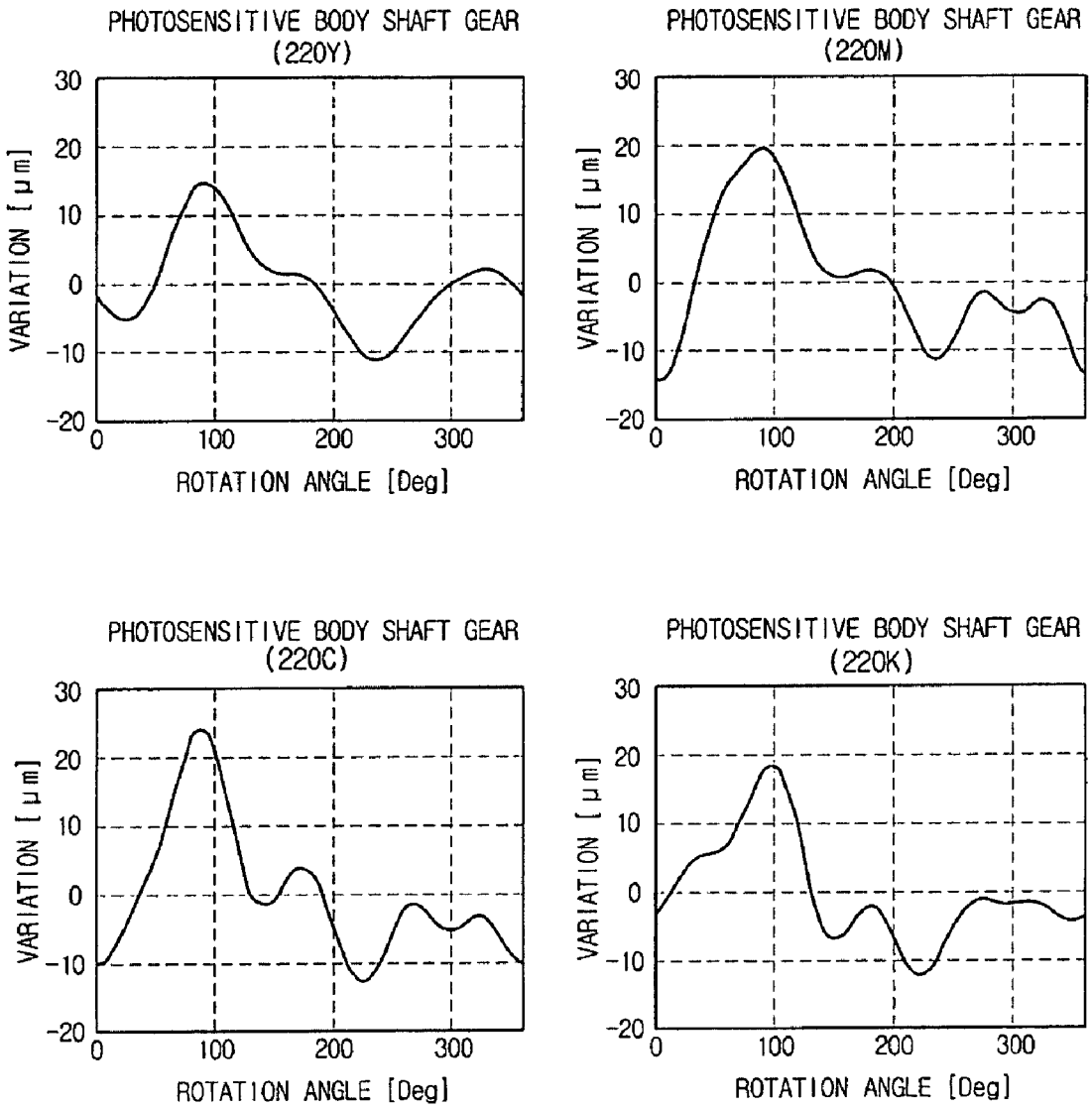
FIGS. 5 to 7 are views illustrating examples of runout profiles related to photosensitive body shaft gears, a first connecting gear, a sixth connecting gear, a second connecting gear and a seventh connecting gear.
Figure 6:
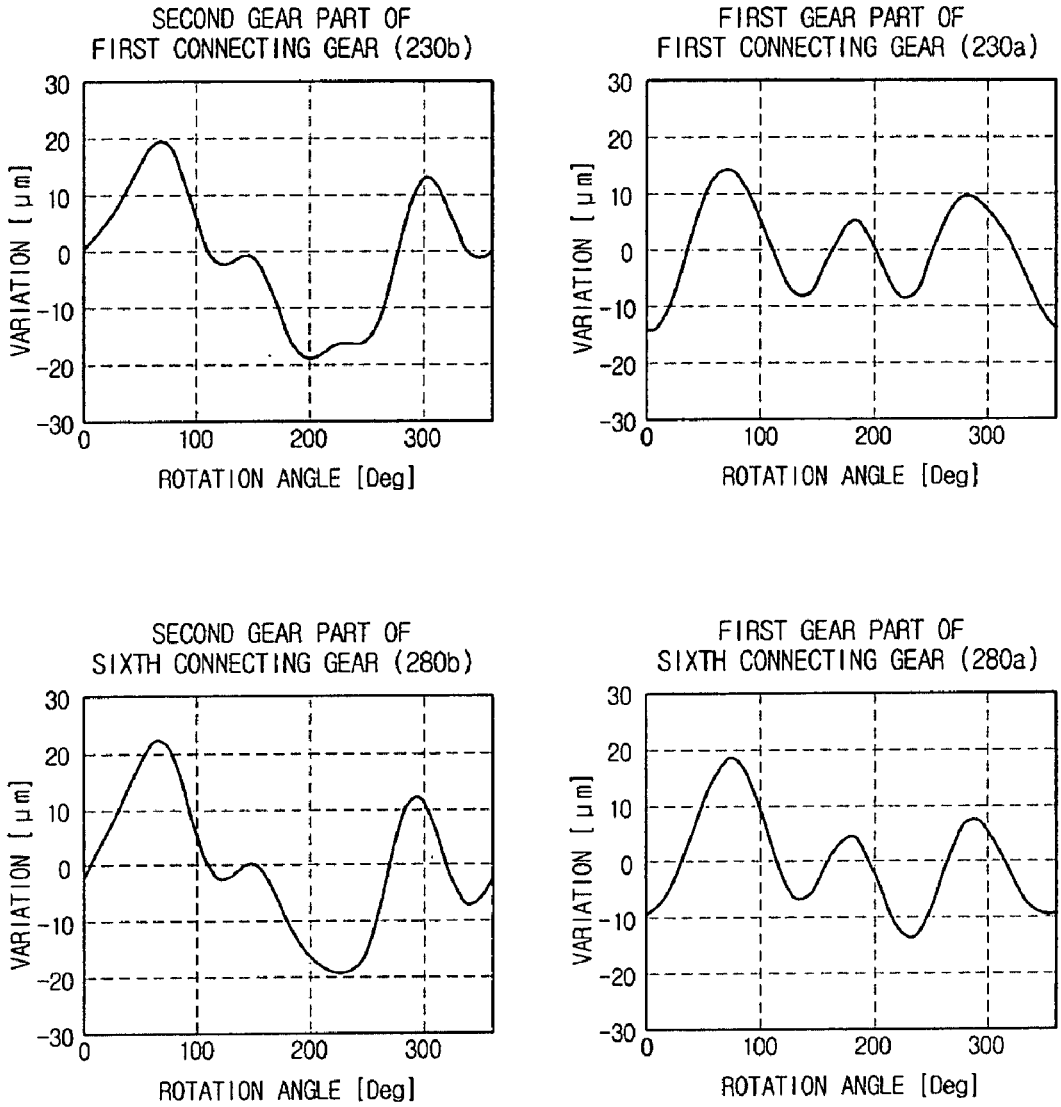
Figure 7:
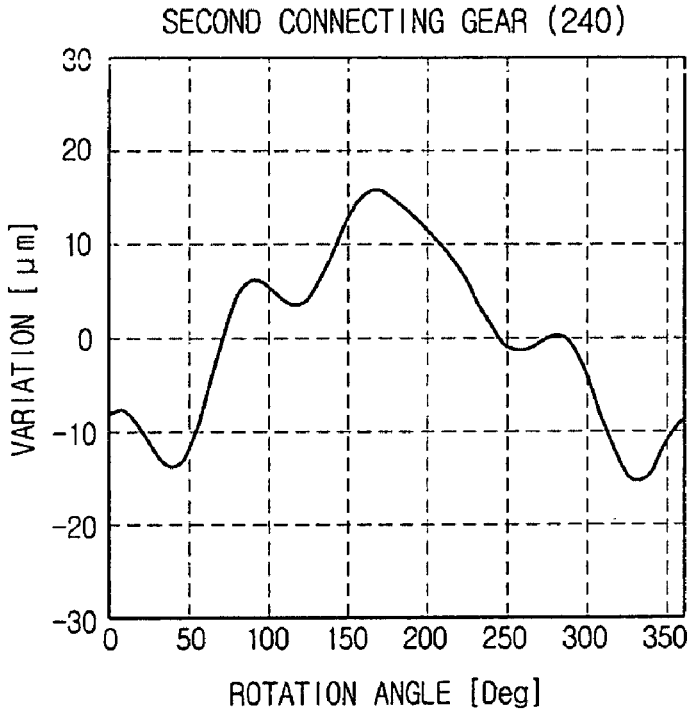
Figure 7:
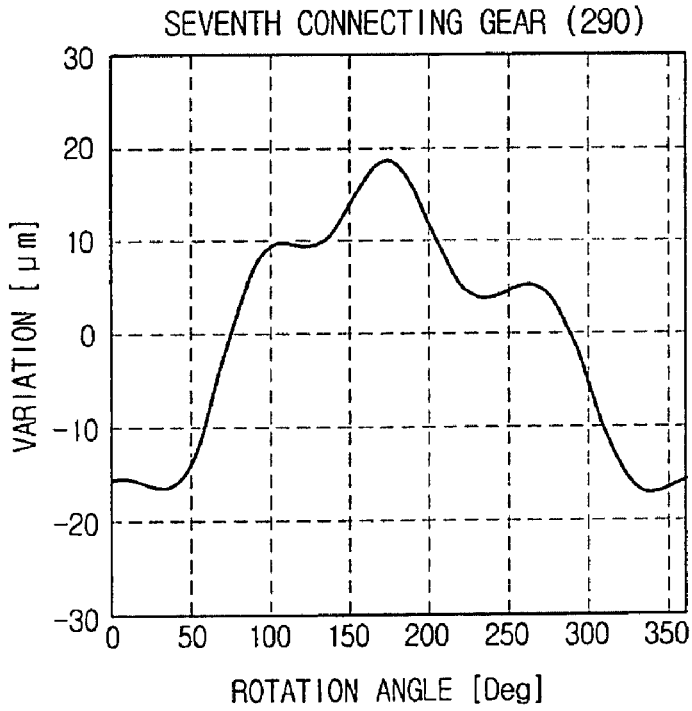

For example, if the gears 220Y, 220M, 220C, 220K, 230, 280, 240 and 290 having the runout profiles as shown in FIGS. 5 to 7 are employed, the angles of θ1, θ2, θ3, θ4, θ5, θ6, θ7 and θ8 are determined to 4.36 rad., 2.37 rad., 2.14 rad., 0.80 rad., 0.56 rad., 0.91 rad., 2.32 rad. and 2.98 rad., respectively. FIGS. 5 to 7 are views illustrating examples of the runout profiles related to the photosensitive body shaft gears 220Y, 220M, 220C and 220K, the first connecting gear 230, the sixth connecting gear 280, the second connecting gear 240 and the seventh connecting gear 290.

Figure 8:
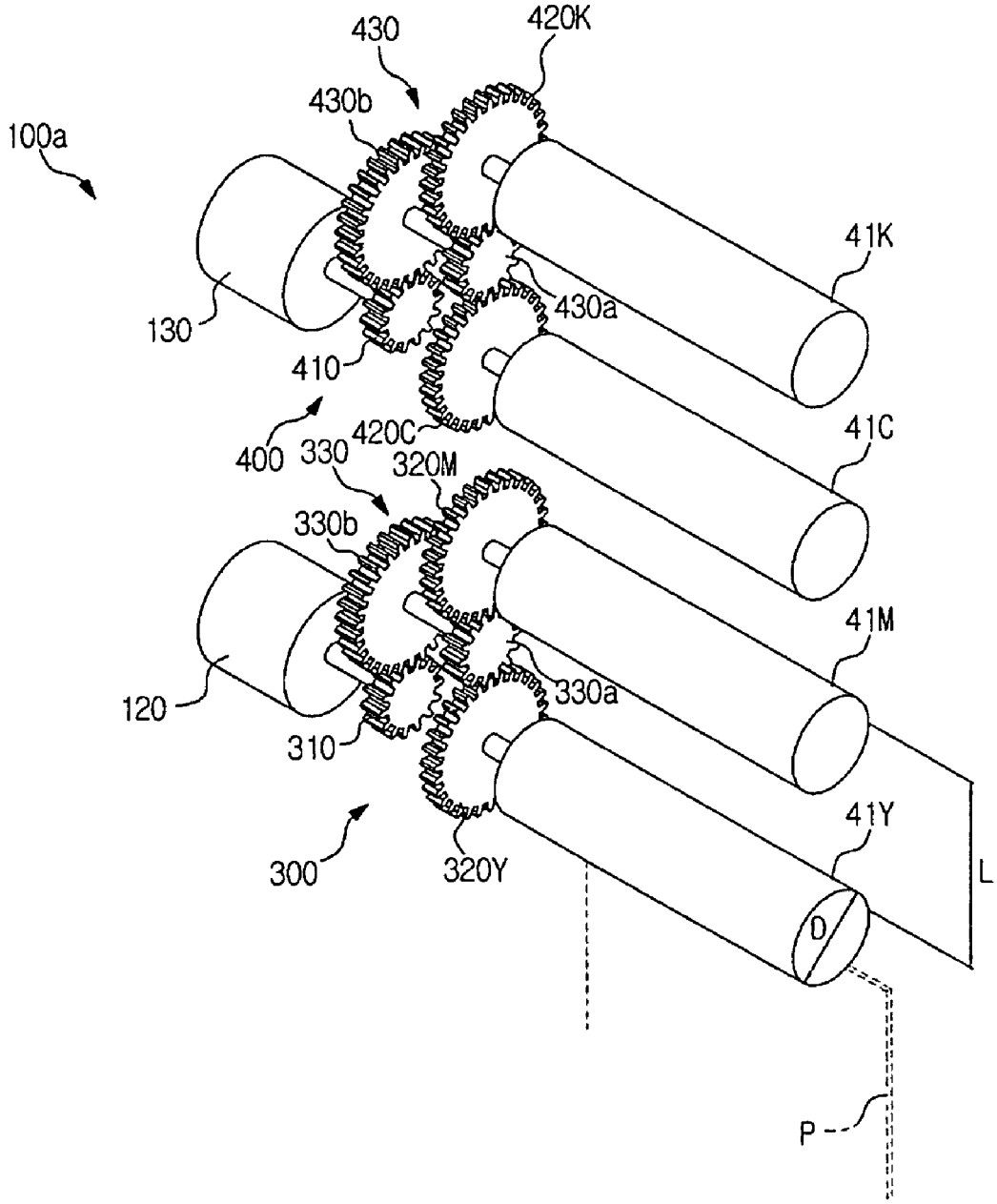
FIG. 8 is a perspective view illustrating photosensitive bodies and a driving unit according to a second embodiment of the present invention.

FIG. 8 is a perspective view illustrating the photosensitive bodies and a driving unit according to a second embodiment of the present invention. This embodiment is configured such that a single driving source drives two photosensitive bodies.

As shown in FIG. 8, a driving unit 100*a* includes a first driving source 120, a second driving source 130, a first driving gear train 300 and a second driving gear train 400.

The first driving source 120 rotates the photosensitive body 41Y for yellow and the photosensitive body 41M for magenta, and the second driving source 130 rotates the photosensitive body 41C for cyan and the photosensitive body 41K for black.

The first driving gear train 300 is disposed between the first driving source 120 and the two photosensitive bodies 41Y and 41M, and transmits the driving power from the first driving source 120 to the two photosensitive bodies 41Y and 41M at a reduced speed by a predetermined speed reduction ratio. The first driving gear train 300 includes a driving shaft gear 310 connected to the first driving source 120, photosensitive body shaft gears 320Y and 320M respectively connected to the photosensitive bodies 41Y and 41M, and a first connecting gear 330 disposed between the driving shaft gear 310 of the first driving source and the two photosensitive body shaft gears 320Y and 320M. The first connecting gear 330 has a first gear part 330 a and a second gear part 330*b*, which are arranged coaxially with each other and have different sizes.

The second driving gear train 400 is disposed between the second driving source 130 and the two photosensitive bodies 41C and 41K, and transmits the driving power from the second driving source 130 to the two photosensitive bodies 41C and 41K at a reduced speed by a predetermined speed reduction ratio. The second driving gear train 400 includes a driving shaft gear 410 connected to the second driving source 130, photosensitive body shaft gears 420C and 420K respectively connected to the photosensitive bodies 41C and 41K, and a second connecting gear 430 disposed between the driving shaft gear 410 of the second driving source and the two photosensitive body shaft gears 420C and 420K. The second connecting gear 430 has a first gear part 430*a* and a second gear part 430*b*, which are arranged coaxially with each other and have different sizes.

Although it is illustrated in FIG. 8 that the first driving gear train 300 has the one connecting gear 330 and the second driving gear train 400 has the one connecting gear 430, a plurality of connecting gears may be installed in the driving gear trains according to a required speed reduction ratio.

Even when it is constituted such that a single driving source drives two photosensitive bodies, like this embodiment, the color mis-registration can be minimized by adequately adjusting the number of teeth and the installation phases of the gears arranged in the first driving gear train 300 and the second driving gear train 400.

More particularly, when any one of the photosensitive body shaft gears 320Y and 320M in the first driving gear train 300 is set to a reference gear, the number of teeth of the gear, which is disposed at the $j^{th}$ position from the reference photosensitive body shaft gear, is determined so as to satisfy the above equation 2. Also, when any one of the photosensitive body shaft gears 420C and 420K in the second driving gear train 400 is set to a reference gear, the number of teeth of the gear, which is disposed at the $j^{th}$ position from the reference photosensitive body shaft gear, is determined so as to satisfy the above equation 2.

After the numbers of teeth of the gears arranged in the first driving gear train 300 and the second driving gear train 400 are totally determined, if the installation phases of all or some gears are determined through a numerical analysis method or a trial-and-error method, the color mis-registration due to the runout of the gears can be minimized.

Figure 9:
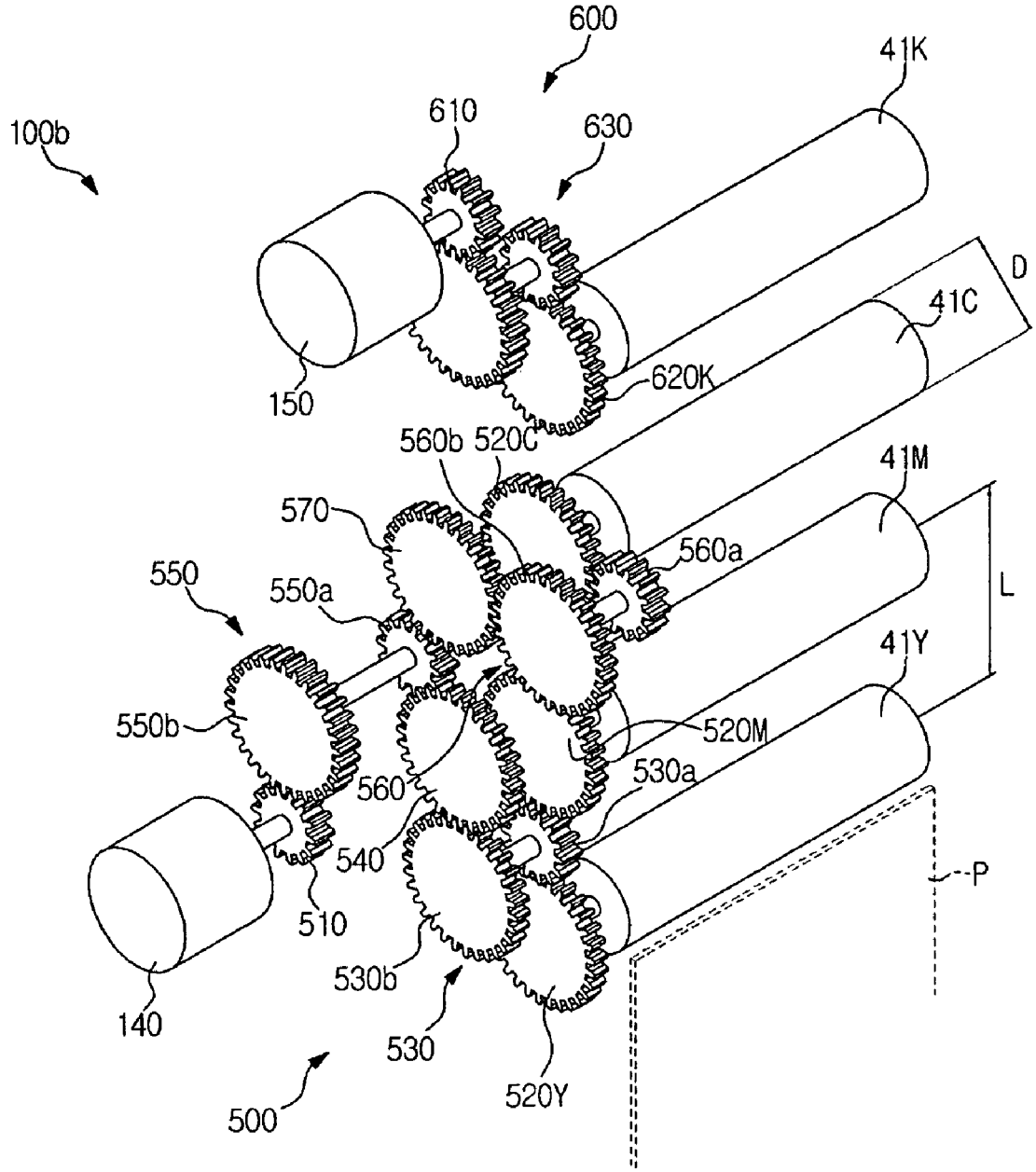
FIG. 9 is a perspective view illustrating photosensitive bodies and a driving unit according to a third embodiment of the present invention.

FIG. 9 is a perspective view illustrating the photosensitive bodies and a driving unit according to a third embodiment of the present invention. This embodiment is configured such that a single driving source drives three photosensitive bodies.

As shown in FIG. 9, a driving unit 100*b* includes a first driving source 140, a second driving source 150, a first driving gear train 500 and a second driving gear train 600.

The first driving source 140 rotates the photosensitive body 41Y for yellow, the photosensitive body 41M for magenta and the photosensitive body 41C for cyan, and the second driving source 150 rotates only the photosensitive body 41K for black.

The first driving gear train 500 is disposed between the first driving source 140 and the three photosensitive bodies 41Y, 41M and 41C, and transmits the driving power from the first driving source 140 to the three photosensitive bodies 41Y, 41M and 41C at a reduced speed by a predetermined speed reduction ratio.

The first driving gear train 500 includes a driving shaft gear 510 connected to the first driving source 140, photosensitive body shaft gears 520Y, 520M and 520C respectively connected to the photosensitive bodies 41Y, 41M and 41C, and a series of connecting gears which transmit the driving power from the first driving source 140 to the photosensitive body shaft gears 520Y, 520M and 520C at a reduced speed by a predetermined speed reduction ratio.

The connecting gears include a first connecting gear 530 to transmit the driving power to the two photosensitive bodies 41Y and 41M, a second connecting gear 540 to transmit the driving power to the first connecting gear 530, a third connecting gear 550 to transmit the driving power to the second connecting gear 540, a fourth connecting gear 560 to transmit the driving power to the photosensitive body 41C, and a fifth connecting gear 570 to receive the driving power from the third connecting gear 550 and transmit the driving power to the fourth connecting gear 560.

The first connecting gear 530, the third connecting gear 550 and the fourth connecting gear 560 serve as a speed reduction gear, and respectively include first gear parts 530*a*, 550*a* and 560*a* and second gear parts 530*b*, 550*b* and 560*b*, which have different sizes from each other.

The second driving gear train 600 is disposed between the second driving source 150 and the photosensitive body 41K, and transmits the driving power from the second driving source 150 to the photosensitive body 41K at a reduced speed by a predetermined speed reduction ratio. The second driving gear train 600 includes a driving shaft gear 610 connected to the second driving source 150, a photosensitive body shaft gear 620K connected to the photosensitive body 41K, and a sixth connecting gear 630 disposed between the driving shaft gear 610 of the second driving source and the photosensitive body shaft gear 620K.

Since the photosensitive body 41K is independently controlled through the second driving source 150, although the color mis-registration due to the runout of the gears arranged in the second driving gear train 600 occurs with respect to the black color, this can be easily solved.

However, with respect to the other colors, the color mis-registration can be minimized by suitably determining the numbers of teeth and the installation phases of the gears arranged in the first driving gear train 500 and the second driving gear train 600.

More particularly, when any one of the photosensitive body shaft gears 520Y, 520M and 520C in the first driving gear train 500 is set to a reference gear, the number of teeth of the gear, which is disposed at the $j^{th}$ position from the reference photosensitive body shaft gear, is determined so as to satisfy the above equation 2.

After the numbers of teeth of the gears arranged in the first driving gear train 500 are totally determined, if the installation phases of all or some gears are determined through a numerical analysis method or a trial-and-error method, the color mis-registration due to the runout of the gears can be minimized.

As apparent from the above description, the image forming apparatus according to the present invention can minimize the color mis-registration due to a defect of the gears, by adjusting the numbers of teeth and the initial installation positions of the gears transmitting the driving power to the photosensitive bodies.

Accordingly, the image forming apparatus according to the present invention can improve image quality while decreasing the number of driving sources to drive the photosensitive bodies and non-using high precision gears.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus, comprising:

a plurality of photosensitive bodies having transfer points to transfer images onto a transfer object;

a driving source to drive at least two photosensitive bodies of the plurality of photosensitive bodies; and a driving gear train to transmit driving power from the driving source to the at least two photosensitive bodies, the driving gear train including photosensitive body shaft gears respectively connected to the photosensitive bodies driven by the driving source, and connecting gears to transmit the driving power to the photosensitive body shaft gears, wherein when one of the photosensitive body shaft gears is set to a reference photosensitive body shaft gear, the number of teeth of the connecting gear, which is disposed at a $j^{th}$ position from the reference photosensitive body shaft gear, is determined so that a value calculated from the following equation is substantially an integer:

$$\frac{L}{\pi D} \cdot \frac{1}{R_j}$$

here, D refers to a diameter of each of the photosensitive bodies, L refers to a distance between the transfer points of two adjacent photosensitive bodies, and $R_j$ refers to a speed reduction ratio from the $j^{th}$ connecting gear to the reference photosensitive body shaft gear.

2. The image forming apparatus according to claim 1, wherein the value has an integer value within an error range of plus or minus 0.1.

3. The image forming apparatus according to claim 1, wherein at least a part of the gears arranged in the driving gear train is adjusted in an initial installation position according to a runout profile of each of the gears.

4. The image forming apparatus according to claim 3, wherein at least a part of the gears arranged in the driving gear train includes a datum mark which serves as a reference in determining the runout profile.

5. The image forming apparatus according to claim 3, wherein the connecting gears include a division gear to divide the driving power transmitted from the driving source, and wherein the gears arranged between the division gear and the photosensitive bodies are adjusted in the initial installation positions according to the runout profiles of the respective gears.

6. The image forming apparatus according to claim 1, wherein the plurality of photosensitive bodies include a first photosensitive body, a second photosensitive body, a third photosensitive body and a fourth photosensitive body.

7. The image forming apparatus according to claim 6, wherein the driving source drives the first photosensitive body, the second photosensitive body, the third photosensitive body and the fourth photosensitive body.

8. The image forming apparatus according to claim 6, wherein the driving source drives the first photosensitive body and the second photosensitive body.

9. The image forming apparatus according to claim 6, wherein the driving source drives the first photosensitive body, the second photosensitive body and the third photosensitive body.

10. An image forming apparatus, comprising:

a plurality of photosensitive bodies having transfer points to transfer images onto a transfer object;

at least one driving source provided fewer than the photosensitive bodies, to drive the plurality of photosensitive bodies; and at least one driving gear train to transmit driving power from the driving source to the plurality of photosensitive bodies, the at least one driving gear train including a first gear, and a second gear disposed at a $j^{th}$ position from the first gear, wherein the second gear is provided so as to satisfy the following equation:

$$\frac{L}{\pi D} \cdot \frac{1}{R_j} = k + \alpha$$

here, D refers to a diameter of each of the photosensitive bodies, L refers to a distance between the transfer points of two adjacent photosensitive bodies, $R_j$ refers to a speed reduction ratio from the second gear to the first gear serving as a reference gear, k refers to an integer value, and $\alpha$ refers to a value satisfying a condition of $-0.1 \leqq \alpha \leqq 0.1$.

11. The image forming apparatus according to claim 10, wherein the at least one driving gear train includes photosensitive body shaft gears respectively connected to the photosensitive bodies, and wherein the first gear is configured as one of the photosensitive body shaft gears.

12. The image forming apparatus according to claim 10, wherein at least a part of the gears arranged in the driving gear train is adjusted in an initial installation position according to a runout profile of each of the gears.

13. The image forming apparatus according to claim 12, wherein each of the gears arranged in the driving gear train includes a datum mark which serves as a reference in determining the runout profile.

14. The image forming apparatus according to claim 10, wherein the at least one driving source includes a first driving source and a second driving source, and wherein the first driving source drives one pair of photosensitive bodies of the plurality of photosensitive bodies, and the second driving source drives another pair of photosensitive bodies of the plurality of photosensitive bodies.

15. The image forming apparatus according to claim 10, wherein the at least one driving source includes a first driving source and a second driving source, and wherein the first driving source drives three photosensitive bodies of the plurality of photosensitive bodies, and the second driving source drives the remaining photosensitive bodies.

16. The image forming apparatus according to claim 10, wherein the at least one driving source drives at least four photosensitive bodies of the plurality of photosensitive bodies.

17. A method of providing rotational force from at least one driving source to a plurality of photosensitive bodies in an image forming apparatus, said at least one driving source being less in number than said plurality of photosensitive bodies, said method comprising:

providing a driving gear train including a plurality of gears, said driving gear train being configured to reduces rotational velocity of said rotational force provided by said at least one driving source, and to deliver said rotational force at said reduced rotational velocity to said plurality of photosensitive bodies, wherein, for at least a first subset of said plurality of gears that delivers said rotational force at said reduced rotational velocity to a first one of said plurality of photosensitive bodies, said plurality of gears of said first subset is arranged to satisfy a relationship defined by:

$$\frac{L}{\pi D} \cdot N = k,$$

wherein L is a distance between rotational axial centers of adjacent ones of said plurality of photosensitive bodies, D is a diameter of said first one of said plurality of photosensitive bodies, N is a first value obtained from multiplying one or more gear ratios between each engaged pair of gears of said first subset, and k is substantially an integer value.

18. The method as set forth in claim 17, wherein said k is within ±0.1 of an integer value.

19. The method as set forth in claim 18, wherein said first subset comprising at least n number of gears, step of providing said driving gear train comprising:

determining a number of teeth of $n^{th}$ gear of said first subset from a gear ratio relationship defined by:

$$N = \frac{Z_1}{Z_2} \cdots \frac{Z_{(n-1)}}{Z_n},$$

where n is an integer.

20. The method as set forth in claim 18, further comprising:

arranging other subsets of said plurality of gears other than said first subset that each delivers said rotational force at said reduced rotational velocity to corresponding one of ones other than said first one of said plurality of photosensitive bodies to satisfy a relationship defined by:

$$\frac{L}{\pi D} \cdot N = k,$$

wherein D is a diameter of said corresponding one of said plurality of photosensitive bodies, N is a first value obtained from multiplying one or more gear ratios between each engaged pair of gears of each of said other subsets.

21. The method as set forth in claim 18, wherein said step of providing said driving gear train comprises:

determining initial positions of said plurality of gears of said driving gear train compensating for eccentricity of one or more of said plurality of gears.

22. The method as set forth in claim 21, wherein said step of providing said driving gear train comprises:

determining initial positions of said plurality of gears of said driving gear train compensating for eccentricity of one or more of said plurality of gears.

* * * * *